United States Patent [19]

Hartline, III

[11] 4,217,136

[45] Aug. 12, 1980

[54] CORROSION RESISTANT AUSTENITIC STAINLESS STEEL

[75] Inventor: Albert G. Hartline, III, Albany, N.Y.

[73] Assignee: Allegheny Ludlum Steel Corporation, Pittsburgh, Pa.

[21] Appl. No.: 6,714

[22] Filed: Jan. 26, 1979

Related U.S. Application Data

[63] Continuation of Ser. No. 465,782, May 1, 1974, abandoned.

[51] Int. Cl.[2] ..... C22C 39/20

[52] U.S. Cl. ..... 75/128 A; 75/126 B; 75/126 J; 75/128 N

[58] Field of Search ..... 75/122, 125, 126 R, 75/126 B, 126 J, 128 A, 128 N; 148/31

[56] References Cited

U.S. PATENT DOCUMENTS

| | | | |
|---|---|---|---|
| 2,745,740 | 5/1956 | Jackson et al. | 75/126 B |
| 2,778,731 | 1/1957 | Carney | 75/126 B |

FOREIGN PATENT DOCUMENTS

| | | | |
|---|---|---|---|
| 892667 | 3/1962 | United Kingdom | 75/126 B |

*Primary Examiner*—M. J. Andrews

*Attorney, Agent, or Firm*—Vincent G. Gioia; Robert F. Dropkin

[57] ABSTRACT

A substantially non-porous, austenitic stainless steel that is resistant to chloride pitting and sulfuric acid and a method for making it are disclosed. The steel includes from 21–45% manganese, from 10–30% chromium, from 0.85–3% nitrogen, from 0–1% carbon, from 0–2% silicon, and at least two elements selected from 1–3% copper, 1–4% nickel and 1–4% molybdenum with the combined weight of copper, nickel and molybdenum not exceeding 5% of the composition, and the balance iron and residuals, wherein the composition is such that:

$$\%Cr + \%Mo + 0.8\,(\%Mn) - 11.8\,(\%N - 0.1) - 1.23\,(\%Ni) - (28.5 + \%Cu) \geqq 0 \quad (1)$$

$$\frac{30\,(\%C + \%N) + 0.5\,(\%Mn) + \%Ni}{\%Cr + \%Mo + 1.5\,(\%Si)} \geqq 1.5 \quad (2)$$

The steel is cast and worked to avoid a dwell period in the temperature range of 1000°–1600° F.

7 Claims, 1 Drawing Figure

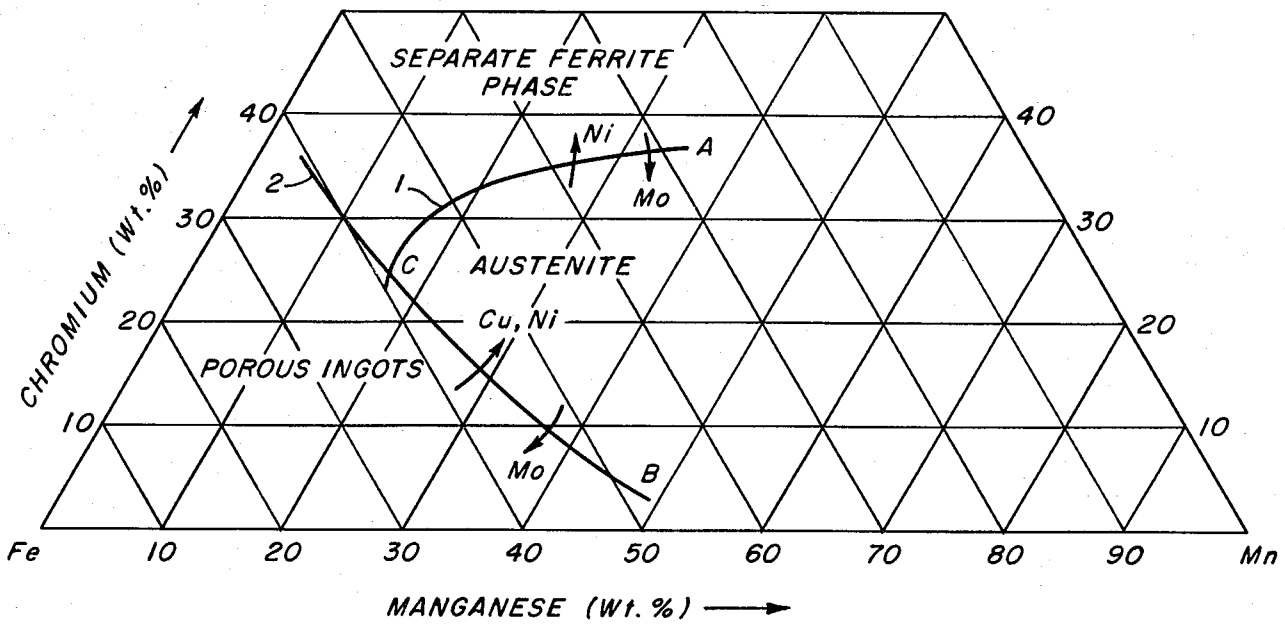
SEPARATE FERRITE PHASE
AUSTENITE
POROUS INGOTS
A
B
C
1
2
Ni
Mo
Cu, Ni
Mo
CHROMIUM (Wt. %)
MANGANESE (Wt. %)
Fe
Mn
10
20
30
40
10
20
30
40
10
20
30
40
50
60
70
80
90

CORROSION RESISTANT AUSTENITIC STAINLESS STEEL

This is a continuation of application Ser. No. 465,782, filed May 1, 1974.

BACKGROUND OF THE INVENTION

Corrosion resistant steels, known as stainless steels, have long been known and are presently available with a variety of properties. Austenitic stainless steels, which are those consisting substantially of a single austenite phase, possess the best properties of corrosion resistance and good mechanical properties, particularly at high temperatures. Austenitic stainless steels in the past have been steels in which chromium and nickel are the principal alloying agents. However, nickel is not an abundant metal, and the increased demand for it has increased its price and made its supply uncertain, particularly in critical times. Substitutes for nickel in the chromium-nickel austenitic stainless steels have long been sought. Recently the combined use of manganese, nitrogen and chromium in carefully balanced amounts has produced an austenitic stainless steel. This steel is described in United States Patent Application Ser. No. 251,637 filed May 8, 1972; and although it is an excellent steel, it is somewhat subject to attack by chloride environments and by dilute sulfuric acid.

SUMMARY OF THE INVENTION

The present invention is a chromium-manganese-nitrogen steel that contains small but critical amounts of at least two of the elements copper, nickel and molybdenum. The alloy of this invention contains from 21–45% manganese, from 10–30% chromium, from 0.85–3% nitrogen, 0–2% silicon, 0–1% carbon, and at least two of 1–3% copper, 1–4% nickel and 1–4% molybdenum with the combined weight of copper, nickel and molybdenum not exceeding 5% and with the balance of the alloy being iron and residuals. All compositions in this specification and the following claims are in percent by weight of the total composition unless otherwise specified.

In addition to being present in the foregoing ranges, the composition of the alloys must be balanced in accordance with the following equations:

$$\%Cr + \%Mo + 0.8\,(\%Mn) - 11.8\,(\%N - 0.1) - 1.23\,(\%Ni) - (28.5 + \%Cu) \geqq 0 \quad (1)$$

$$\frac{30\,(\%C + \%N) + 0.5\,(\%Mn) + \%Ni}{\%Cr + \%Mo + 1.5\,(\%Si)} \geqq 1.5 \quad (2)$$

In the alloys of the present invention, chromium must be present to produce the same effect that it does in prior art alloys. The alloys of this invention must contain from 10–30% chromium. At least 10% chromium is required to give the steel its outstanding corrosion resistance. Chromium also has a secondary effect upon the strength of the steel and is a primary element in increasing the steels solubility for nitrogen. An upper limit of 30% chromium is imposed as chromium is a ferrite former, and excessive amounts of ferrite might form with higher chromium levels and in turn degrade the properties of the steel. A preferred chromium content is in the range of 15–27% in that steels containing this range of chromium are easy to process while still having good corrosion resistance and strength.

The manganese in the alloy of this invention is present in amounts from 21–45%. Since manganese is an austenitizer and increases the solubility of nitrogen in the steel, amounts in excess of 21% are required. An upper limit of 45% and preferably an upper limit of 30% manganese is imposed for economic considerations and because manganese tends to attack furnace refractories.

Nitrogen, a strong austenitizer, should be present in the steel in amounts of from 0.85–3%. At least 0.85% is required for its austenitizing effect and because it is the primary strengthening element of the steel. Amounts of nitrogen in excess of 3% tend to yield porous ingots which are not satisfactory. The nitrogen content of the alloy of this invention preferably is from 1.05–1.5%.

The copper, nickel and molybdenum content of the alloy of this invention must be from 2–5%; at least two of the three elements, copper, nickel, molybdenum must be present in the alloy; and when present those elements must be present in the range of 1–3% copper, 1–4% nickel and 1–4% molybdenum. By having present in the alloy at least two of those three elements, it has been found that an alloy that is resistant both to chloride pitting and dilute sulfuric acid is obtained and that greater amounts of alloying elements may be added to the steel without causing porous ingots to form and without causing a separate phase to form. In the past, one or more of copper, nickel or molybdenum have been used to improve one or another property of the chromium-manganese-nitrogen stainless steels; but in improving one property, a negative effect was had on another. For example, adding copper to such a stainless steel will improve its resistance to corrosion when contacted with dilute sulfuric acid, but the presence of copper reduces the solubility of the alloy for nitrogen thereby causing porous ingots unless other composition modifications are made. Accordingly, improving corrosion resistance to sulfuric acid in the past required giving up a desirable property. Similarly, the addition of molybdenum to such alloys increased the solubility of nitrogen so that a strong austenitic steel could be formed, but the presence of molybdenum promoted the formation of a separate ferrite phase so that some composition adjustments had to be made to avoid a two-phase product when a one-phase austenitic steel was desired. The presence of nickel in such alloys improved the resistance of the alloy to chloride pitting. However, the presence of nickel reduced the solubility of nitrogen so that limited amounts of nickel could be used or other modifications in the composition of the alloy had to be made to accommodate to nickel.

In the present invention, the use of nickel in combination with copper and molybdenum permits the addition of nickel to the alloy composition and avoids the negative effects thereof. Obviously, depending upon the results desired, it is necessary to balance the amounts of copper, nickel and molybdenum to achieve alloy compositions that will be suitably resistant to chloride pitting and dilute sulfuric acid corrosion while still being one-phase austenitic steels that can be cast as nonporous ingots.

Carbon is a well known austenitizer and strengthener and is employed in the alloys of this invention in amounts up to 1%. The concentration of carbon must be maintained below that level in that larger amounts can remove chromium from solid solution by combining with it to form chromium carbide and because carbon can reduce the solubility of the steel for nitrogen by occupying interstitial sites normally filled with nitrogen. It is preferred that less than 0.15% carbon be present in the alloy of this invention. Higher carbon contents require higher annealing temperatures to put carbides into solution.

The alloys of the present invention may tolerate silicon concentrations as high as 2%, but preferably the silicon content is maintained below 1%. Larger quantities of silicon tend to remove manganese by forming manganese silicate and tend to form inclusions in the steel.

Although the residuals in iron need not be identified and do not significantly affect the properties of the alloy, the usual residuals may be identified as phosphorus, sulfur, tungsten and cobalt.

Since the stainless steel composition of this invention is desirably a one-phase austenetic material, thermal treatments that tend to precipitate other phases should be avoided. Although the alloys of this invention are not particularly sensitive to precipitation of other phases, the method of preparation employed should avoid long dwell periods in the 1000°-1600° F. temperature range. Long dwell periods would be characterized by furnace cooling. For ordinary thicknesses, air cooling or quenching are sufficient to carry the alloy through the 1000°-1600° F. range quickly enough to avoid precipitation of detrimental phases such as sigma phase.

DETAILED DESCRIPTION OF THE INVENTION

The accompanying drawing is a plot of the 1.0% nitrogen section of the iron-chromium-manganese phase diagram. As indicated in equations (1) and (2) set forth above, nickel has a significant effect both on the austenitic structure of the alloy and on the ability of the alloy to maintain nitrogen in solution. From equation (1), which is an expression of the composition necessary to maintain nitrogen in solution, it may be seen that increases in the nickel concentration of the alloy tend to reduce the solubility of nitrogen. However, from equation (2), which is an expression of the composition limits necessary to avoid formation of a separate ferrite phase, it may be seen that nickel additions to the alloy suppress the formation of ferrite. In the accompanying drawings, equation (1) is represented by line 2 while equation (2) is represented by line 1. As indicated by the arrows, additions of nickel to the alloy composition would tend to displace both lines 1 and 2 upwardly.

It is also evident from equation (1) that additions of copper will tend to reduce the solubility of nitrogen in solution and will cause line 2 in the illustration to move upwardly as more copper is introduced into the alloy. However, the addition of molybdenum to the alloy composition increases the solubility of nitrogen and tends to move the line 2 downwardly as indicated by the arrow in the drawing. The addition of molybdenum, however, promotes formation of a separate ferrite phase so that as molybdenum is added to the composition, the line 1 tends to move downwardly as indicated by the arrows in the drawing.

Thus, in accordance with the present invention, a great deal of latitude becomes available in compositing alloys to have specific properties. When it is desired to have an alloy that resists corrosion by dilute sulfuric acid and that resists chloride pitting, additions of copper and nickel will produce those desirable results. When both copper and nickel are provided to the alloy, the composition ranges where single-phase austenite can be achieved are abundant, although they may be different than if the alloy contained no copper and nickel. The area A-C-B in the drawing is the area where single-phase austenite is obtained, and it may be seen that when both copper and nickel are added to the alloy, that range will simply move upwardly on the diagram although it will still be well within the composition ranges of the alloys of this invention.

If it is desired to have non-porous ingots with lower manganese and chromium content, the addition of molybdenum to the alloy will increase the solubility of nitrogen so that the area A-C-B in the drawing will move downwardly and to the left. If it is desired to increase the nitrogen content of the alloy leaving the copper and nickel concentrations the same, the addition of molybdenum to the alloy will insure the production of non-porous ingots. In accordance with this invention, the properties of the alloy may be balanced to provide varying degrees of resistance to chloride pitting and sulfuric acid corrosion; and the composition of the alloy may be balanced to avoid excessive use of manganese or chromium by selection of at least two of the elements copper, nickel and molybdenum; and adding the same to the alloy in the amounts indicated by the results desired.

To demonstrate the benefits of this invention, five alloys were prepared having the compositions set forth in Table I.

TABLE I

| | ALLOY NUMBER | | | | |
|---|---|---|---|---|---|
| Element | 1 | 2 | 3 | 4 | 5 |
| Mn | 30.40 | 29.95 | 29.90 | 29.90 | 30.25 |
| Cr | 20.45 | 20.03 | 19.84 | 20.03 | 19.98 |
| N | 1.00 | 1.07 | 1.06 | 1.06 | 1.01 |
| Cu | 0.20 | 1.00 | 0.01 | 1.00 | 1.00 |
| Ni | 0.26 | 1.10 | 1.05 | 0.19 | 1.14 |
| Mo | 0.033 | 1.00 | 0.95 | 1.00 | 0.05 |
| C | 0.092 | 0.104 | 0.110 | 0.100 | 0.100 |
| Si | 0.48 | 0.40 | 0.45 | 0.40 | 0.46 |
| S | 0.009 | 0.009 | 0.010 | 0.011 | 0.010 |
| P | 0.014 | 0.008 | 0.008 | 0.008 | 0.008 |

The alloys desribed in Table I are all nominally 30% manganese, 20% chromium, 1% nitrogen alloys. Alloy 1 contains only trace amounts of copper, nickel and molybdenum; alloy 2 contains nominally 1% of each; alloy 3 contains nominally 1% each of nickel and molybdenum; alloy 4 contains nominally 1% each of copper and molybdenum; and alloy 5 contains nominally 1% each of copper and nickel. All of alloys 2-5 are alloys in accordance with this invention.

The alloys described in Table I were all prepared in the same way. All alloys were prepared from melted materials in an air induction furnace and were composited from commercial grades of ferro alloys and pure elements. The heats were cast from approximately 2650° F. into 35 pound cast iron ingot molds. After solidification, the ingots were examined for porosity which was not observed in any of the alloys. The hot processing of all alloys consisted of grinding to remove casting imperfections, heating the ingots to 2250° F. for an appropriate amount of time and hot rolling to the desired width and thickness. All ingots were rolled without serious difficulties. The hot rolled materials were annealed at 2250° F. on a schedule of 60 minutes per inch of thickness, subsequently blasted and pickled in 15% nitric acid and 3% hydrofluoric acid, cold rolled to further homogenize the structure and final annealed at 1950° F. on a schedule of 120 minutes per inch of thickness. The rolled material was then pickled.

At various stages of the processing, samples were obtained to determine the mechanical properties of the metals and to observe the microstructure of the metal. The microstructure of all metals was consistently found to be austenitic. Tensile strength, yield strength, elongation and other mechanical properties of all of Alloys 1–5 were not significantly different thereby indicating that the addition of at least two of the elements copper, nickel and molybdenum had no effect on the mechanical properties of the alloy.

The alloys of this invention are resistant to pitting attack in chloride environments. The resistance to pitting attack is measured by a potentiokinetic technique. In this technique an alloy specimen is placed in contact with an appropriate chloride solution and an electrical potential is imposed on the specimen at increasing voltage until a breakthrough point at which a surge of current passes through the solution. Higher breakthrough potentials indicate greater resistance to chloride pitting. A significant aspect of the potentiokinetic technique is that the ability of an alloy to self-passivate may be found by reversing the potential to determine where a high resistance to current flow is obtained after the breakthrough. Alloys with a tendancy to self-passivate display a decrease in voltage at a voltage nearer the breakthrough potential.

All of the alloys described in Table I showed better resistance to chloride pitting in potentiokinetic tests than the usual stainless steel. All of the alloys exhibited very good resistance to chloride pitting and resistance to chloride pitting of about the same magnitude as each other. However, Alloys 2, 3, 4 and 5 showed better self-passivation properties than Alloy 1. Therefore the potentiokinetic tests indicated that one could expect adequate resistance to chloride pitting from all of the alloys, but the alloys of this invention would additionally display good self-passivating properties.

Specimens of Alloys 1 through 5 inclusive were also subjected to standard corrosion testing to measure their resistance to sulfuric acid. Resistance of an alloy to sulfuric acid is measured by exposing a specimen to sulfuric acid and obtaining the anodic polarization data and the cathodic polarization data and determining their intersection point on a plot of voltage versus current. A corrolation is known to exist between the intersection points of these lines and the resistance of the specimen to sulfuric acid corrosion. The intersection of these lines at lower current indicates better resistance to sulfuric acid. In testing the alloys described in Table I, it was found that in standardized tests obtaining anodic polarization data in 1.0 normal solutions of sulfuric acid that the corrosion current at the intersection point of the anodic and cathodic polarization data curves for Alloy 1 was 5.0 ($mA/cm^2$); whereas for Alloys 2 through 5 respectively, these intersection points were at 0.012, 0.0013, 0.012 and 0.0014 ($mA/cm^2$), thereby indicating that Alloys 2 through 5 have significantly better resistance to sulfuric acid corrosion than Alloy 1.

What is claimed is:

1. A nonporous, austenitic alloy that is resistant to chloride pitting and sulfuric acid consisting essentially of 21–45% manganese, 10–30% chromium, 0.85–3% nitrogen, 0–1% carbon, 0–2% silicon, and at least two elements selected from 1–3% copper, 1–4% nickel, and 1–4% molybdenum, with the combind weight of copper, nickel and molybdenum not exceeding 5%, and the balance iron and residuals, wherein the composition is such that:

$$\%Cr + \%Mo + 0.8\,(\%Mn) - 11.8\,(\%N - 0.1) - 1.23\,(\%Ni) - (28.5 + \%Cu) \geqq 0 \quad (1)$$

$$\frac{30\,(\%C + \%N) + 0.5\,(\%Mn) + \%Ni}{\%Cr + \%Mo + 1.5\,(\%Si)} \geqq 1.5. \quad (2)$$

2. A nonporous, austenitic alloy according to claim 1, having from 21–30% manganese.

3. A nonporous, austenitic alloy according to claim 1, having from 15–27% chromium.

4. A nonporous, austenitic alloy according to claim 1, having from 1.05–1.5% nitrogen.

5. A nonporous, austenitic alloy according to claim 1, having up to 0.15% carbon.

6. A nonporous, austenitic alloy according to claim 1, having up to 1% silicon.

7. A method for producing a substantially nonporous austenitic stainless steel which comprises compositing an alloy consisting essentially of 21–45% manganese, 10–30% chromium, 0.85–3% nitrogen, 0–1% carbon, 0–2% silicon, and at least two elements selected from 1–3% copper, 1–4% nickel, and 1–4% molybdenum with the combined weight of copper, nickel, and molybdenum not exceeding 5% and the balance iron and residuals, wherein the composition is such that:

$$\%Cr + \%Mo + 0.8\,(\%Mn) - 11.8\,(\%N - 0.1) - 1.23\,(\%Ni) - (28.5 + \%Cu) \geqq 0 \quad (1)$$

$$\frac{30\,(\%C + \%N) + 0.5\,(\%Mn) + \%Ni}{\%Cr + \%Mo + 1.5\,(\%Si)} \geqq 1.5 \quad (2)$$

melting said material to form a homogeneous liquid phase and solidifying the resultant liquid phase without a dwell period in the temperature range from about 1000°–1600° F.

* * * * *